US005890494A

United States Patent [19]

Sonstegard

[11] Patent Number: 5,890,494

[45] Date of Patent: Apr. 6, 1999

[54] DEVICE FOR STYLING HAIR

[76] Inventor: Lois J. Sonstegard, 2320 Devin La., Orono, Minn. 55356

[21] Appl. No.: 839,602

[22] Filed: Apr. 15, 1997

Related U.S. Application Data

[63] Continuation of Ser. No. 512,041, Aug. 7, 1995, abandoned, which is a continuation-in-part of Ser. No. 336,485, Nov. 9, 1994, abandoned.

[51] Int. Cl.[6] ..... A45D 8/04; A45D 8/34; A45D 8/36

[52] U.S. Cl. ..... 132/273; 132/246; 132/247; 132/275

[58] Field of Search ..... 132/246, 247, 132/273, 275, 222, 233; 63/3, 11; 24/575, 576, 579.1

[56] References Cited

U.S. PATENT DOCUMENTS

| | | | |
|---|---|---|---|
| 1,538,809 | 5/1925 | Henry | 132/447 |
| 1,945,932 | 2/1934 | Caley | 132/247 |
| 2,378,872 | 6/1945 | Stone | 132/247 |
| 2,415,914 | 2/1947 | Silverman | 132/247 |
| 2,649,097 | 8/1953 | Chernack | 132/246 |
| 4,834,118 | 5/1989 | Goeller | 132/233 |
| 5,115,825 | 5/1992 | Kuhn | 132/275 |

*Primary Examiner*—Gene Mancene
*Assistant Examiner*—Pedro Philogene
*Attorney, Agent, or Firm*—Robert M. Rauker

[57] ABSTRACT

A device for styling hair is disclosed. The device includes a flexible, elongated body portion having an elongated opening for receiving hair. The main body portion is deformed to create a continuous hair receiving opening. The elongated body portion also has a first female end and a second male end. A hair styling device comprising an elongated body portion with an elongated slot is also described.

8 Claims, 3 Drawing Sheets

DEVICE FOR STYLING HAIR

This is a continuation of prior application Ser. No. 08/512,041, filed Aug. 7, 1995, now abandoned, which is a continuation-in-part of prior application Ser. No. 08/336,485, filed Nov. 9, 1994, abandoned.

BACKGROUND OF THE INVENTION

The present invention relates to hair styling devices, namely devices for forming French knots, buns and the like.

Long hair styles are popular with people of all ages, particularly with women. Because of the popularity of long hair styles, several devices have been invented for styling long hair. Examples include barrettes, hair ties, combs and ornamental hair pins.

Of the hair styling devices that are currently known, there are few devices that exist which are useful for styling long hair into a bun, a French knot, or similar style.

There are soft sponge-like rings that are known. The ring is covered with a fine netting material, which can be used by drawing the hair through the opening in the sponge, wrapping the hair around the ring and securing the hair onto the ring by trapping the hair and the netting material together with hair pins. The rings described above can also be formed from a fabric such as woven nylon covered with a nylon netting. Typically, the rings have an outer diameter of approximately four inches and have an inner diameter of approximately two inches.

There are disadvantages in using a soft ring to form a hair bun. It is difficult to wrap smooth, thick hair around the ring, pin the hair down and have the hair remain in place. It is also quite time consuming to wrap the hair around the ring when the hair is long. When the hair being styled is shorter, it may not be possible to wrap the hair completely around the ring.

There are flexible combs that are known having two ends which can be opened to install the comb around hair, and then closed to form a substantially circular ring. Flexible combs have many sharp, pointed edges which can scrape the scalp. Such a comb is also not particularly useful for styling hair into a bun. The flexible combs described above are primarily intended to be used to form French knots.

There are currently no known hair styling devices which can be used to rapidly and easily form a French knot, bun or similar hair style.

SUMMARY OF THE INVENTION

The present invention is a device for styling hair. The invention includes a flexible elongated body portion. The elongated body portion includes a first end, a second end and an elongated opening located between the first and second end for receiving hair. A continuous opening is created by deforming the elongated body. The invention in its broadest sense also includes a means for securing hair positioned in the opening. Examples of a means for securing hair includes an elongated body formed from a material that will deform under force, and either return to its original shape in response to withdrawing the force or in response to application of an opposite force.

DETAILED DESCRIPTION

The present invention is a novel device for styling hair. The device of the present invention is particularly suited for use with long hair, and more particularly for forming buns and French knots.

Figure 1:
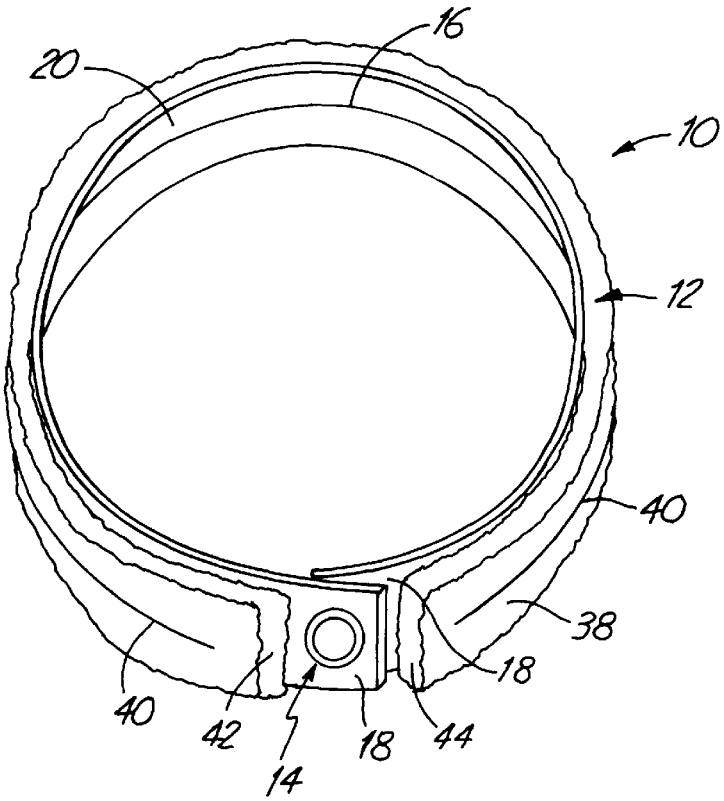
FIG. 1 is a perspective view of a first preferred embodiment of the present invention, shown with first and second ends attached.

The device of the present invention includes an elongated body portion with a first end, a second opposite end and an elongated opening extending between the first and second ends. A perspective view of a first example of such a device is shown at 10 in FIG. 1. The elongated body portion 12 includes a flexible, resilient support strip 14 which in the preferred embodiment is approximately 10 ⅜ inch in length, is about ¾ inch in width and has a thickness of approximately 1/16 inch. Preferably, the elongated body portion is formed of a deformable material which returns to its original shape when the force causing the deformation is removed.

Preferably, the elongated body is formed of a plastic material such as polyvinyl chloride which can be flexed repeatedly and which returns to its original shape. An example of a suitable plastic that can be used to form this support strip 14 is high density polyethylene (HDPE) which is widely available. The elongated body of the first preferred embodiment is high density polyethylene which is available from Primex Plastice Corporation of Richmond, Ind.

Figure 2:
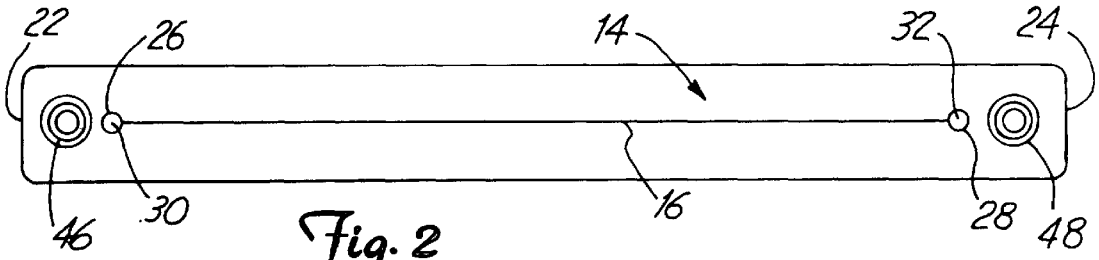
FIG. 2 is a bottom elevational view of a first preferred embodiment of the present invention.

The device of the present invention includes an elongated opening for receiving hair, wherein the main body portion is deformed in order to create a continuous opening for receiving the hair. In the first embodiment, this opening is created by means of a longitudinal slit 16 extending completely through top and bottom major surfaces 18 and 20 (shown in FIG. 3). Referring now to FIG. 2, in the first embodiment, the longitudinal slit 16 is shorter in length than a length of the support strip 14 and stops short of the first end 22, and second opposite end 24 so that when the elongated body 14 is deformed, a continuous opening is created. Most preferably, the longitudinal slit 16 has a first end 26 and a second end 28, each end terminating in a substantially circular opening 30, 32. In the first preferred embodiment, the circular openings are approximately ⅛ inch in diameter. The openings 30 and 32 are provided to allow the slit 16 to be opened wide enough to easily insert a strand of hair.

Figure 3:
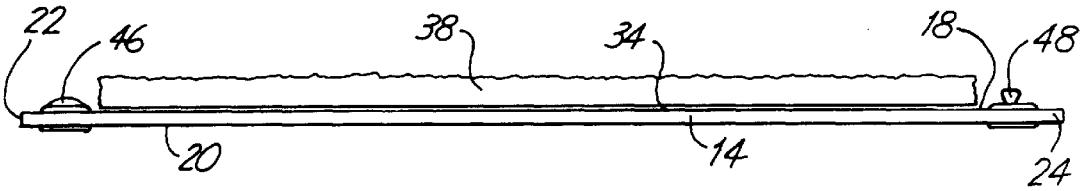
FIG. 3 is a side-elevational view of a first preferred embodiment of the present invention.

Referring back to FIG. 1, at least one of the first major surface 18 or the second major surface 20 has a high coefficient of friction so that hair positioned within the elongated slit 16 and wrapped around the elongated strip 14 does not easily slide out of slit 16. In the first embodiment, a strip of open cell foam 38, having a thickness of approximately ¼ inch is affixed to the first major surface 18 by means of an adhesive layer 34 as shown in FIG. 3. An example of a suitable foam is polyurethane open cell foam available from Future Foam, Inc. of Council Bluffs, Iowa (a Nebraska corporation) under the product designation "30100." The preferred foam strip has a minimum elongation of 125 percent, a maximum compression set of 10 percent at 50 percent C.O.M., an indention force deflection at 25 percent of 4 inches, a density of 1 pound per cubic foot, plus or minus 1/10, a minimum tensile strength of 10 pounds per square inch and a minimum tear strength of 1.25 pounds per inch. All of the physical characteristics described above are measured in accordance with ASTM-D-3574-88.

The preferred adhesive layer 39 for use with this foam and the high density polyethylene plastic strip 14 is available from Maple Leaf Sales, Ltd. of Plymouth Mich. under the trade name "K-Grip Solvent Cement."

Preferably, the plastic strip 14 is formed by means of injection molding. The elongated slit 16 and circular openings 30 and 32 are cut into the strips after the strips are released from the mold. The adhesive layer 34 can be brushed or sprayed onto the major surface 18. Preferably, the adhesive is applied in the form of a spray, and the foam is applied to the adhesive.

The foam strip 38 also has a longitudinal cut 40 which extends through the entire thickness of the foam strip 38 and which is aligned with the longitudinal cut 16 of the elongated strip 14. Preferably, the foam strip 38 covers a majority of the first major surface 18, but has ends 42 and 44 which are located far enough from ends 22 and 24 (shown in FIG. 2), respectively to allow sufficient clearance for providing a means for removably attaching the first and second ends 42 and 44.

It is to be understood that it would be equally useful to provide a high friction surface on the second major surface 20 or on both the first and second major surfaces 18 and 20.

Preferably, the device of the present invention is equipped with a fastening means for removably attaching the first end 22 to the second opposite end 24. Referring to FIGS. 2 and 3, a conventional snap 46, 48 is provided to secure the first end 22 to the second end 24 after the device is in place in the hair. Although snaps were chosen as the preferred fastening means, the present invention also contemplates the use of a hook and loop type closure such as a product available under the trade name Velcro, a hook and eye, a button and button hole, an elongated slit and pin with an enlarged head, a hook and loop configuration with a transverse loop to guide the ends together and any other conventional fastening devices.

In operation, the user applies force to the elongated body portion in a manner which creates an opening defined by inner edges of the longitudinal slit 16. The hair to be styled is placed within the opening. Each end 22 and 24 of the device is twisted until the hair is wrapped around the elongated body 12 and positioned in the desired location. At this point, the ends are either drawn together and fastened, forming a "bun" style, or the ends are concealed within the hair and pinned into place, forming a "French knot."

Figure 4:
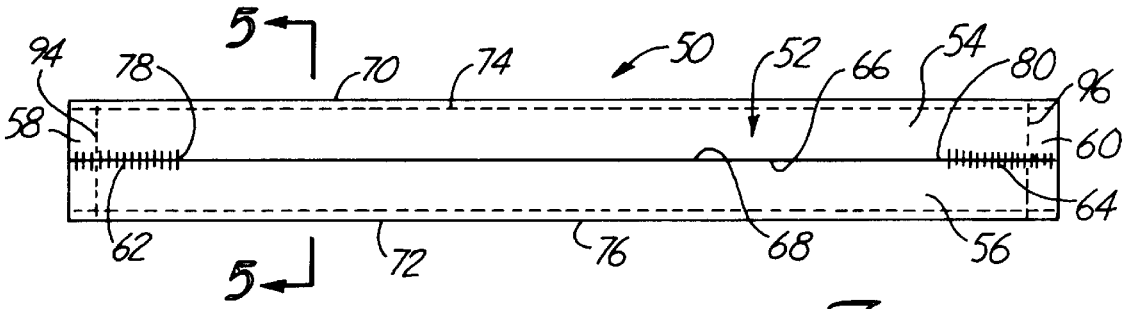
FIG. 4 is a top elevational view of a second preferred embodiment of the present invention.

A second preferred embodiment of the present invention is shown at 50 in FIG. 4. In this embodiment, the elongated body portion 52 is formed of a flexible, deformable material that lacks an ability to return to its initial shape when a deformation force is removed. The elongated body portion 52 of this example is formed from a cloth material that has a high coefficient of friction. Preferably the elongated body is constructed from woven cotton. Other woven materials such as terry cloth, muslin, wool, netting and fleece would also be suitable.

Preferably, the elongated body portion 52 comprises two substantially identical sleeves 54, 56 which in the preferred embodiment are tacked together at each end 58, 60 by means of end stitching 62, 64. The ends may also be tacked together by means of metal clips (not shown). The construction of the second preferred embodiment of the present invention is shown in more detail in cross-section in FIG. 5.

Figure 5:
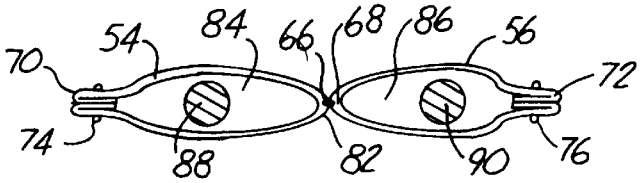
FIG. 5 is a cross-sectional view of a second preferred embodiment of the present invention, taken through line 5—5 as shown in FIG. 4.

FIG. 5 is a cross-sectional view of the second embodiment taken along line 5—5 as shown in FIG. 4. Each sleeve 54, 56 is folded to form a first folded edge 66, 68 and a second opposite infolded edge 70, 72. Raw edges of the fabric are infolded, and the edges 70, 72 are stitched together by means of stitching 74, 76. Both sleeves 54 and 56 define the elongated body 52 of the second preferred embodiment.

First folded edges 66 and 68 extending from inner edges 78, 80 of end stitches 62 to 64 define the elongated opening 82 of the second preferred embodiment. Because the elongated body in this example is formed of flexible fabric, it is necessary to add a deformable material to pockets 84, 86 located within sleeves 54 and 56. Preferably, 8 gauge copper wires 88, 90 are positioned within the pockets 84 and 86 and extend beyond end stitching 62 and 64 toward ends 58 and 60, respectively.

Figure 6:
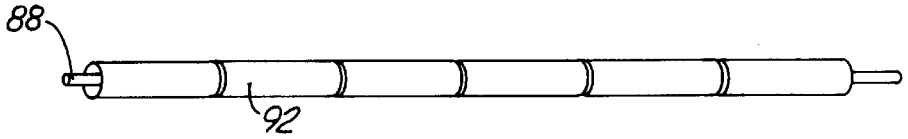
FIG. 6 is a perspective view of a wire of a second preferred embodiment, extending through a plurality of semi-rigid plastic tubes.
Figure 7:
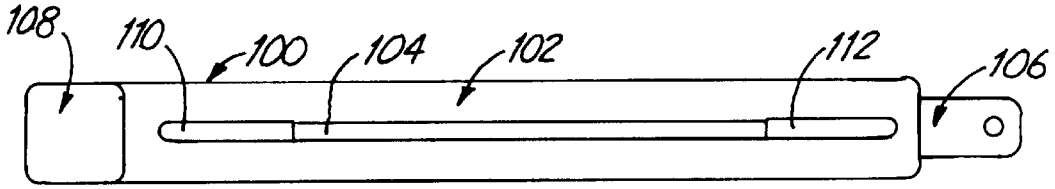
FIG. 7 is a top elevational view of a third preferred embodiment of the present invention.

Although it is believed that hair to be styled with the device of the present invention is adequately protected from the wires 88 and 90 by the sleeves 54 and 56, in another embodiment, plastic tubing is placed over the wire before insertion into each sleeve 54, 56. As shown in FIG. 6, plastic tubing segments 92 can be placed over each wire 88, 90 (not shown) for greater protection of the hair against damage. Flexible tubing can also be used, which would eliminate the need to cut the tubing into segments prior to sliding over the wires 88 and 90. Referring back to FIG. 4, after the wires 88 and 90 are inserted into the sleeves 54 and 56, the ends 58 and 60 are infolded and stitched together, forming stitching 94 and 96. The stitching 94 and 96 traps the wires 88 and 90 permanently in the sleeves 54 and 56.

In operation, the sleeves 54 and 56 are drawn apart by the application of force. Hair to be styled is placed in an elongated opening 82 defined by separated edges 66 and 68. Then, force is applied to the wires 88 and 90 in a direction opposite the force applied to create the opening. Each end 58 and 60 is grasped, and then twisted until the hair has reached the desired shape. Then, the ends may be secured together, in the case of forming a hair bun, or the ends may be turned under and pinned, forming a French knot.

Although no fastening means is shown in FIG. 4, it would be desirable to include a fastener at each end such as a hook and loop marketed under the trade name Velcro. The addition of the fastening arrangement in the case of both the first and second embodiments increases the utility of this device. Devices of the present invention with end closures are particularly suited for forming buns.

Figure 10:
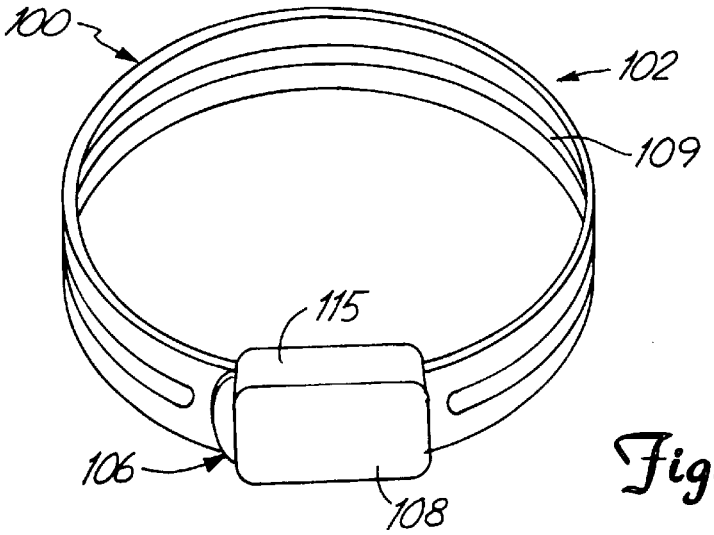
FIG. 10 is a perspective view of the third preferred embodiment shown with first and second ends attached.

One other embodiment of the hair styling device of the present invention illustrated generally at 100 in FIG. 10 includes a main body 102 enclosing an elongated slit 104 and terminating in a male clasp end 106 and an opposing female clasp end 108. The main body 102 is preferably a unitary main body made of a flexible, injection-molded, polymeric material. The polymeric material preferably has a coefficient of friction that is effective for securing hair, positioned in the slit 104, to the main body 102. One acceptable polymer for use in this embodiment of the present invention is Santoprene®, a thermoplastic elastomer manufactured by Monsanto Corp. of St. Louis, Mo.

The unitary main body embodiment 100 includes a constrictor section 110 adjacent to the female end 108 and an opposing constrictor section 112 adjacent to the male end 106. The constricting sections 110 and 112 define the elongated slit 104. The constrictor sections 110 and 112 are thinner than the main body 102.

The hair styling device may have a range of acceptable lengths and widths. For the unitary main body embodiment 100, preferred lengths range from about five inches to about eight inches. In one embodiment, the device has a width of one-half inch. Apart from the ends, the device, in one embodiment, has a maximum thickness of about one-eighth inch.

Figure 8:
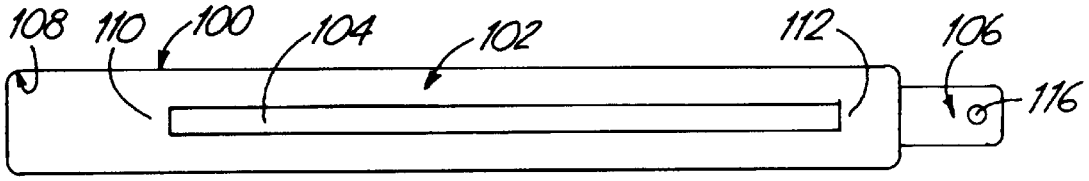
FIG. 8 is a bottom elevational view of the third preferred embodiment of the present invention.
Figure 9:
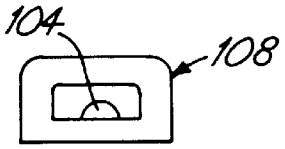
FIG. 9 is a cross-sectional view of a female portion of a clasp mechanism of the third preferred embodiment of the present invention.

The constricting sections 110 and 112 are integral with the main body 102 as is shown in an elevational view of the bottom of the styling device, in FIG. 8. Further, each of the female end 108 and the male end 106 is also integral with the elongated main body 102 and is made of the same material as the main body 102.

The hair styling device is secured to hair in a manner described for the embodiment 10. To fasten the hair styling device 100, the male end 106 is inserted into the female end 108 as shown in FIG. 10. The female end 108 includes a tunnel 115 enclosing a nub 114 that catches the male end 106 at a hole 116 enclosed by the male end 106. The flexible and deformable properties of the injection-molded material used to make the third embodiment 100 of the present invention permits the male end 106 to pass over the nub 114 and "catch" the nub at the hole 116. The nub 114 and tunnel 115 trap the male end 106.

Although the present invention has been described with reference to the preferred embodiments, workers skilled in the art will recognize that changes may be made in form and detail without departing from the spirit and scope of the invention.

What is claimed is:

1. A device for styling hair, the device comprising:

a flexible, deformable elongated body portion having a central longitudinal axis, the body portion including:

a first end terminating in a male end mechanism, the male end mechanism comprising an elongated end having a central longitudinal axis parallel with the central longitudinal axis of the elongated body portion;

a second end opposite the first end and terminating in a female end mechanism, the female end mechanism comprising an elongated cavity having a central longitudinal axis parallel with the central longitudinal axis of the elongated body portion, the cavity having an open end located at a terminal edge of the second end and suitable for operably receiving the male end mechanism therein keeping the central longitudinal axis of the male end parallel to the central longitudinal axis of the female end; and an elongated slit opening having opposing margins through the elongated body portion, the slit opening positioned between the first and second ends for receiving hair;

wherein the elongated body portion is deformable so as to separate the opposing margins of the slit opening.

2. The device of claim 1 wherein the female end mechanism and the male end mechanism are integrally formed with the flexible elongated body portion at their respective second and first ends.

3. The device of claim 1 wherein the elongated body portion includes a material having a coefficient of friction sufficient to prevent hair from slipping through the elongated slit opening when the hair is drawn through and wrapped around the elongated body portion.

4. The device of claim 1 wherein the elongated body portion includes an injection molded, flexible polymer, wherein the elongated slit opening comprises a longitudinal cut extending through a thickness of the elongated body and is located along the central longitudinal axis of the elongated body portion, wherein the cut extends from a point near the first end to a point near the second end.

5. A device for styling hair, the device comprising:

a flexible, deformable elongated body portion having a central longitudinal axis, the body portion including:

a first end terminating in a male end mechanism, the male end mechanism comprising an elongated end having a central longitudinal axis parallel with the central longitudinal axis of the elongated body portion;

a second end opposite the first end and terminating in a female end mechanism, the female end mechanism comprising an elongated cavity having a central longitudinal axis parallel with the central longitudinal axis of the elongated body portion, the cavity having an open end located at a terminal edge of the second end and suitable for operably receiving the male end mechanism therein keeping the central longitudinal axis of the male end parallel to the central longitudinal axis of the female end; and an elongated, slotted opening within the elongated body portion positioned between the first and second ends having a first longitudinal edge and a second adjacent longitudinal edge opposite the first edge for receiving hair therethrough;

wherein the elongated body portion is deformable.

6. The device of claim 5 wherein the female end mechanism and the male end mechanism are integrally formed with the elongated body portion.

7. The device of claim 5 wherein the elongated body portion includes a material having a coefficient of friction sufficient to prevent hair from slipping out of the slotted opening when drawn through the slotted opening and wrapped around the elongated body portion.

8. The device of claim 5 wherein the elongated body portion includes an injection molded, flexible polymer.

* * * * *